US005299589A

United States Patent [19]

Zatulovsky

[11] Patent Number: 5,299,589

[45] Date of Patent: Apr. 5, 1994

[54] ORTHOPEDIC CRUTCH WITH ADJUSTABLE HAND GRIP

[75] Inventor: Leo Zatulovsky, Northridge, Calif.

[73] Assignee: Guardian Products, Inc., Simi Valley, Calif.

[21] Appl. No.: 881,531

[22] Filed: May 12, 1992

[51] Int. Cl.[5] ..... A61H 3/02

[52] U.S. Cl. ..... 135/68; 135/72

[58] Field of Search ..... 135/68, 71, 72, 76; 403/17, 18, 322, 374

[56] References Cited

U.S. PATENT DOCUMENTS

| | | | |
|---|---|---|---|
| 596,203 | 12/1897 | Drake . | |
| 705,741 | 7/1902 | Drew . | |
| 904,481 | 11/1908 | Hood . | |
| 1,225,364 | 5/1917 | Sanders . | |
| 1,253,117 | 1/1918 | Allen . | |
| 2,208,796 | 7/1940 | Jaenichen et al. | 403/18 |
| 2,429,409 | 10/1947 | Eidman | 135/72 |
| 2,669,244 | 2/1954 | Greene et al. . | |
| 2,793,647 | 5/1957 | Urie et al. . | |
| 2,825,591 | 3/1958 | Mulder | 403/374 |
| 3,277,767 | 10/1966 | Allen et al. | 403/322 X |
| 3,335,735 | 8/1967 | Colegrove et al. . | |
| 3,710,807 | 1/1973 | Ferry | 135/68 |
| 3,768,495 | 10/1973 | Smith . | |
| 4,054,396 | 10/1977 | Neuman | 403/374 X |
| 4,596,484 | 6/1986 | Nakatani | 403/374 X |
| 4,753,259 | 6/1988 | Hansen et al. | 135/68 |
| 4,786,022 | 11/1988 | Grieshaber | 403/374 X |
| 4,809,995 | 3/1989 | Ramunas | 403/322 X |
| 4,979,533 | 12/1990 | Hansen et al. . | |

FOREIGN PATENT DOCUMENTS

| | | | |
|---|---|---|---|
| 187555 | 7/1907 | Fed. Rep. of Germany | 135/69 |
| 702634 | 1/1954 | United Kingdom | 135/68 |

OTHER PUBLICATIONS

A portion of an undated brochure showing elbow crutches manufactured by Gauthier-Villot and believed to be sold by Walk Easy, Inc.

*Primary Examiner*—Carl D. Friedman
*Assistant Examiner*—Lan C. Mai
*Attorney, Agent, or Firm*—Willian Brinks Hofer Gilson & Lione

[57] ABSTRACT

Described is an orthopedic crutch with an adjustable hand grip that can slide along the vertical supports and be fixed to the supports at different vertical elevations to accommodate the user.

6 Claims, 6 Drawing Sheets

ORTHOPEDIC CRUTCH WITH ADJUSTABLE HAND GRIP

BACKGROUND OF THE INVENTION

The present invention relates to an orthopedic crutch and, more particularly, to an orthopedic crutch with an adjustable hand grip.

Many different orthopedic crutches have been designed and manufactured to assist injured and handicapped individuals. Since individual users vary in height, efforts have been made to design and construct orthopedic crutches which are adjustable to the height of the user. For the most part, such orthopedic crutches tend to require complex adjustment mechanisms and procedures to accomplish adjustment.

Recently, however, an orthopedic crutch has been proposed which can be adjusted comparatively simply by the user without assistance. Such a crutch is disclosed in Hansen et al. U.S. Pat. No. 4,979,533, dated Dec. 25, 1990. The crutch described comprises two vertical supports with an upper arm rest and a third vertically adjustable lower support. The lower support fixes the overall height of the crutch. In addition, a hand grip is provided which is also relatively easily adjusted to provide proper spacing between the hand grip of the crutch and the arm rest.

The present invention provides an alternative adjustable hand grip for an orthopedic crutch which is also simple and easy to operate by the user without the need of assistance.

SUMMARY OF THE INVENTION

According to the invention there is provided an orthopedic crutch comprising a pair of spaced apart, generally parallel vertical, preferably tubular, supports rigidly attached to one another, an arm support attached to the upper end of the vertical supports and a vertically adjustable hand grip fixable to the vertical supports. In one embodiment each of the vertical supports has a plurality of spaced apart detents along one longitudinal surface and in another embodiment the vertical supports have a plurality of spaced apart apertures along one longitudinal surface. The hand grip comprises means, such as tubular sleeves, surrounding each vertical support and slidable thereover and a bracket extending between the vertical supports and rigidly connecting the sleeves. The sleeves in both embodiments accommodate a locking member extending through an aperture in the sleeve adjacent the vertical support.

In the embodiment where the vertical supports are provided with detents, the locking member has on a portion of the surface thereof, detent engaging means to engage and be supported within a detent in the vertical support and has on another portion of the surface thereof an area which is configured so as to not engage a detent. The locking member, and means to rotate same, are attached to the sleeve to enable the hand grip to be vertically adjusted by disengaging and engaging the detents in vertical supports through rotation of the member so that the hand grip may be placed at an adjustable distance from the arm support to suit the user.

In a preferred version of the just described embodiment each sleeve has an aperture adjacent a vertical support extending through the sleeve generally tangentially to the vertical supports. The aperture accommodates a rotatable locking member which is insertable into and through the aperture so that when the locking member is rotated to place the detent engaging surface within a detent in the vertical supports, the hand grip is fixed to the vertical supports. Disengaging the detent by rotation of the locking member enables the hand grip to be relocated by sliding the sleeves up or down along the vertical supports. In this way, the hand grip may be moved vertically to be placed and fixed at an adjustable distance from the arm support of the orthopedic crutch.

In another, and presently preferred embodiment, the vertical supports are provided with apertures on a longitudinal surface, as previously mentioned, and the sleeves are provided with an aperture alignable with apertures in the vertical supports. The locking member for locking the sleeve to a vertical support comprises a generally U-shaped clamp which surrounds a portion of the sleeve and a pin fixed to the clamp. The legs of the U-shaped clamp are biased into contact with the sleeve, such as by being slightly undersized with respect to the sleeve's diameter, at least at the ends thereof, and the pin fixed to the clamp is moveable into and out of the apertures in the sleeve and vertical support when they are aligned by moving the clamp toward or away from the vertical supports.

DETAILED DESCRIPTION OF THE DRAWINGS

DETAILED DESCRIPTION OF THE PREFERRED EMBODIMENT

Figure 1:
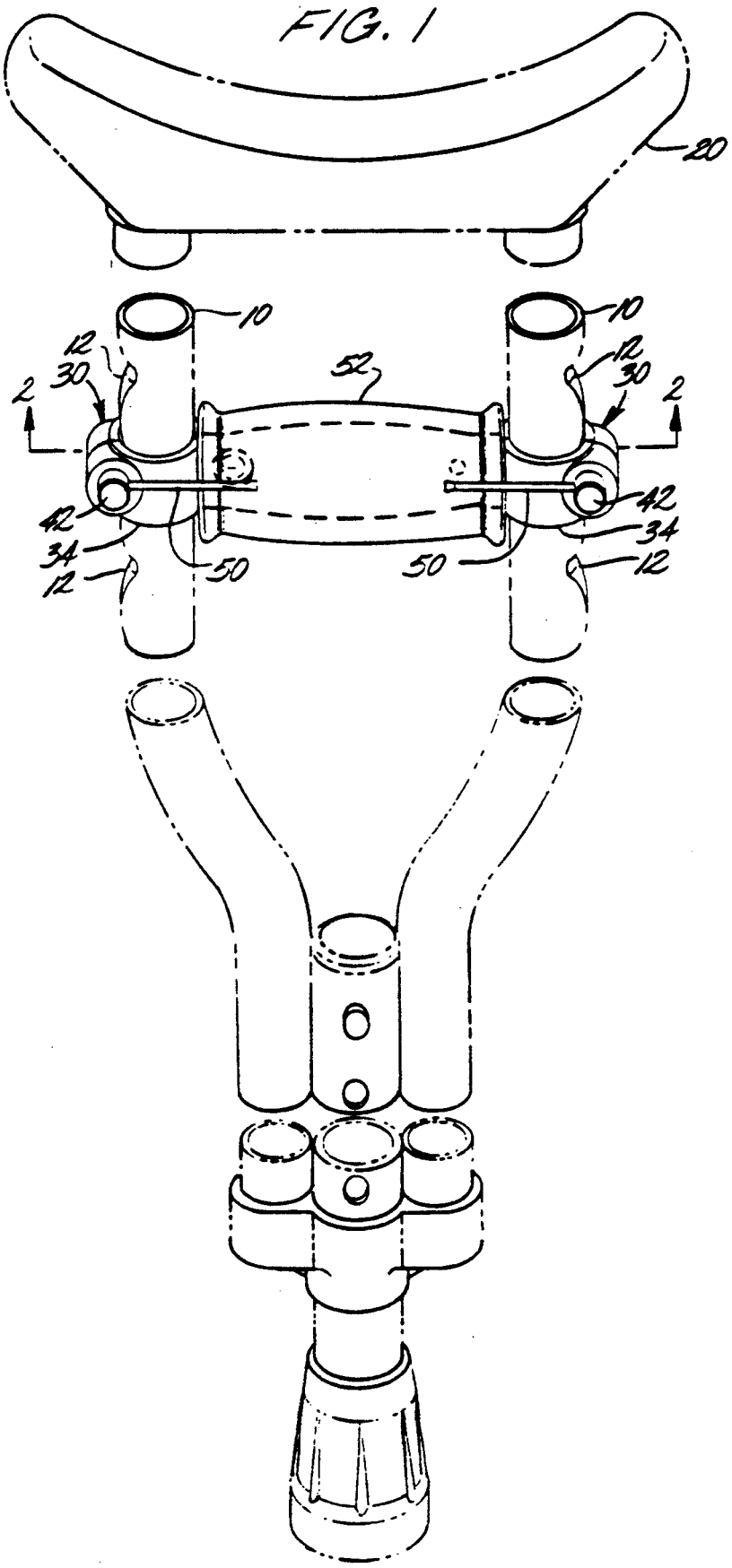
FIG. 1 is a perspective view showing the orthopedic crutch and adjustable hand grip in accordance with one embodiment of the invention; this view shows the locking member in an engaged position with respect to the vertical supports.
Figure 2:
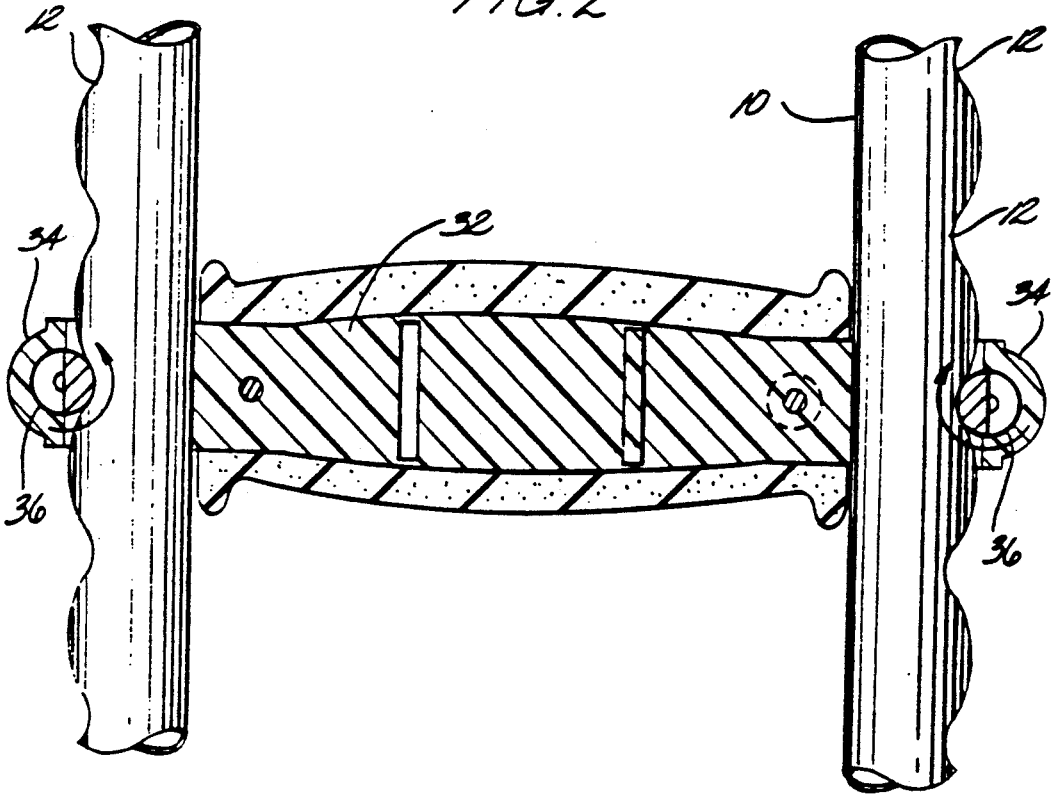
FIG. 2 is a sectional view taken along 2—2 of FIG.
Figure 3:
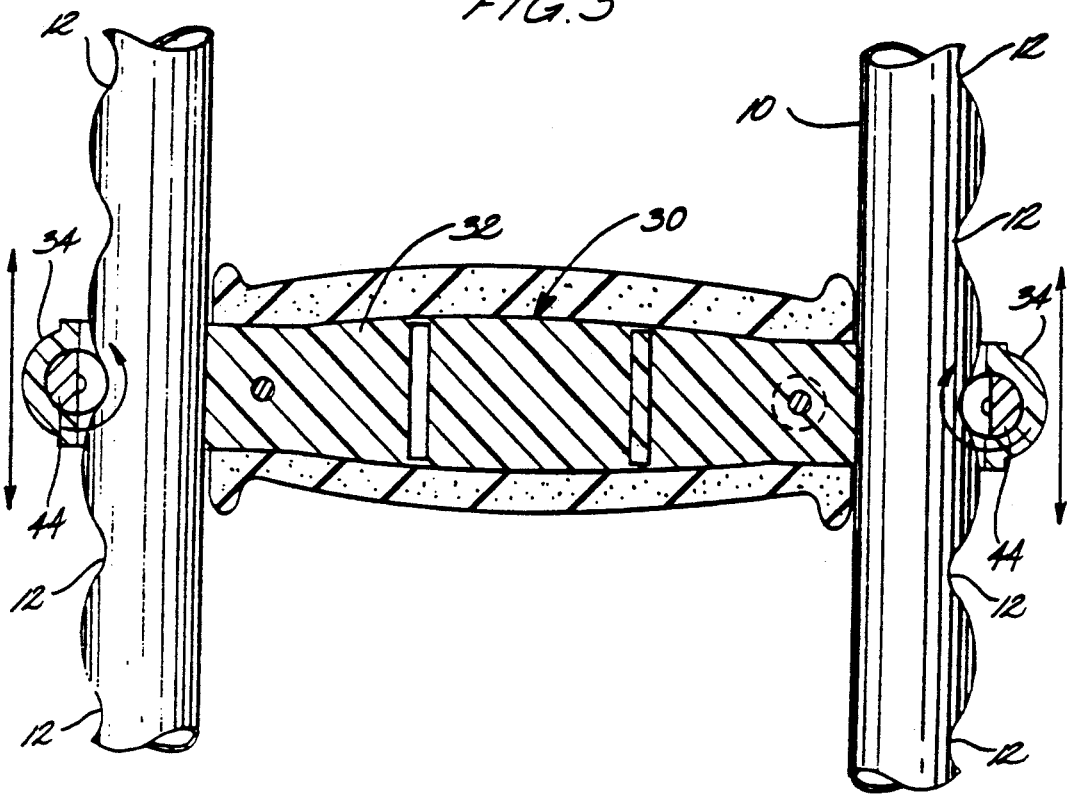
FIG. 3 is a sectional view similar to FIG. 2 showing the locking member in a disengaged position with respect to the vertical supports.

One embodiment of the invention is shown in FIGS. 1–5 of the drawings, wherein like numerals refer to like parts. In this embodiment there is provided an orthopedic crutch which comprises a pair of generally parallel, vertical tubular supports 10 rigidly attached to one another, an arm support 20 attached to the upper ends of the vertical supports and an adjustable hand grip 30. The vertical supports 10 are provided with a plurality of spaced apart detents 12 along one longitudinal surface.

The adjustable hand grip comprises a pair of tubular sleeves 34, one of which surround each vertical support 10, which are slidable over the vertical supports. The sleeves 34 are rigidly connected to each other by a bracket 32 extending between vertical supports 10. Each sleeve 34 has an aperture 36 extending through the sleeve adjacent and generally tangential to a vertical support 10. The aperture forms a passageway for rotatable locking member 42.

Figure 4:
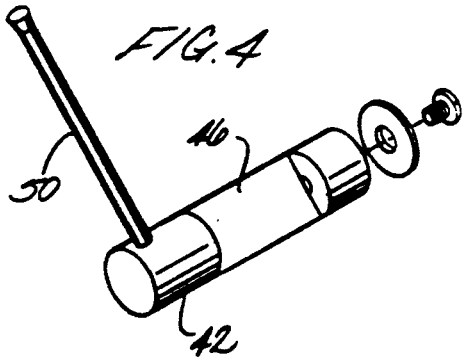
FIG. 4 is a detail perspective view of the locking member.
Figure 5:
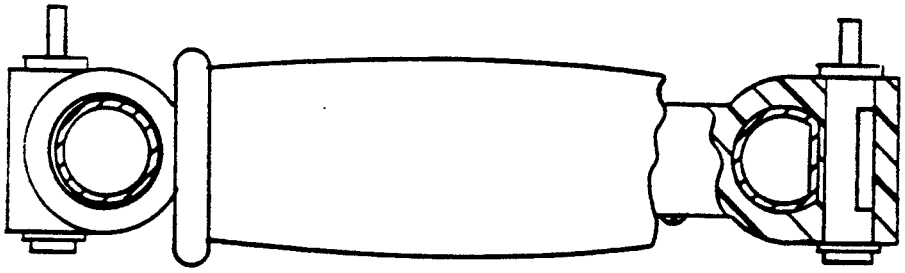
FIG. 5 is a top view with a partial cut-away showing the locking member in the engaged position.

The rotatable locking member 42, best seen in FIG. 4, is insertable through aperture 36 in sleeve 34 and is configured so as to have a detent engaging surface 44 and a surface 46 which will not engage detents 12 when rotated to face vertical support 10. In other words, locking member 42 comprises a bar with a "D" shaped notch, as shown in FIG. 4. The locking member 42 is rotatable by any suitable rotating means, such as by lever 50 fixed to member 42, in the direction of the arrows shown in FIGS. 2 and 3 into positions to disengage and engage detents 12.

When the detent engaging surface 44 is rotated by lever 50 into engagement with vertical support 10 by being positioned within detent 12, the hand grip 30 is in the fixed or locked position with respect to the vertical supports 10. The distance between the hand grip 30 and arm support 20 is adjusted by simply rotating lever 50 to disengage the locking member from the detent 12 in the vertical support 10, slidably adjusting the location of the hand grip by moving the tubular sleeves 34 upwardly or downwardly as, for example, in the direction of the arrows shown in FIG. 3, to achieve a desired position after which the hand grip may be locked in that position by rotating lever 50 so that the detent engaging surface 44 is fixed and locked in positioned within the detent 12.

Various changes may be made to the embodiment just described. For example, the detents 12 shown on the outer surface of the vertical supports may be alternately placed along the inside surface. A rubber cushion 52 may be provided around the bracket 32 to facilitate gripping by the user and the size and configuration of the parts of the hand grip and the vertical supports may be varied. Any suitable means to rotate the locking member 42 may be used in lieu of lever 50 shown in the drawings and the configuration of the locking member itself may be varied so long as it is configured with one surface to engage the detents in the vertical supports and another surface which does not engage the detents. A cam or eccentrically shaped bar may be used for this purpose. For simplicity the locking member 42 may be secured within the aperture 36 of tubular sleeve 30 by means of the screw and washer shown in FIG. 4, however any other suitable means may also be employed.

Figure 6:
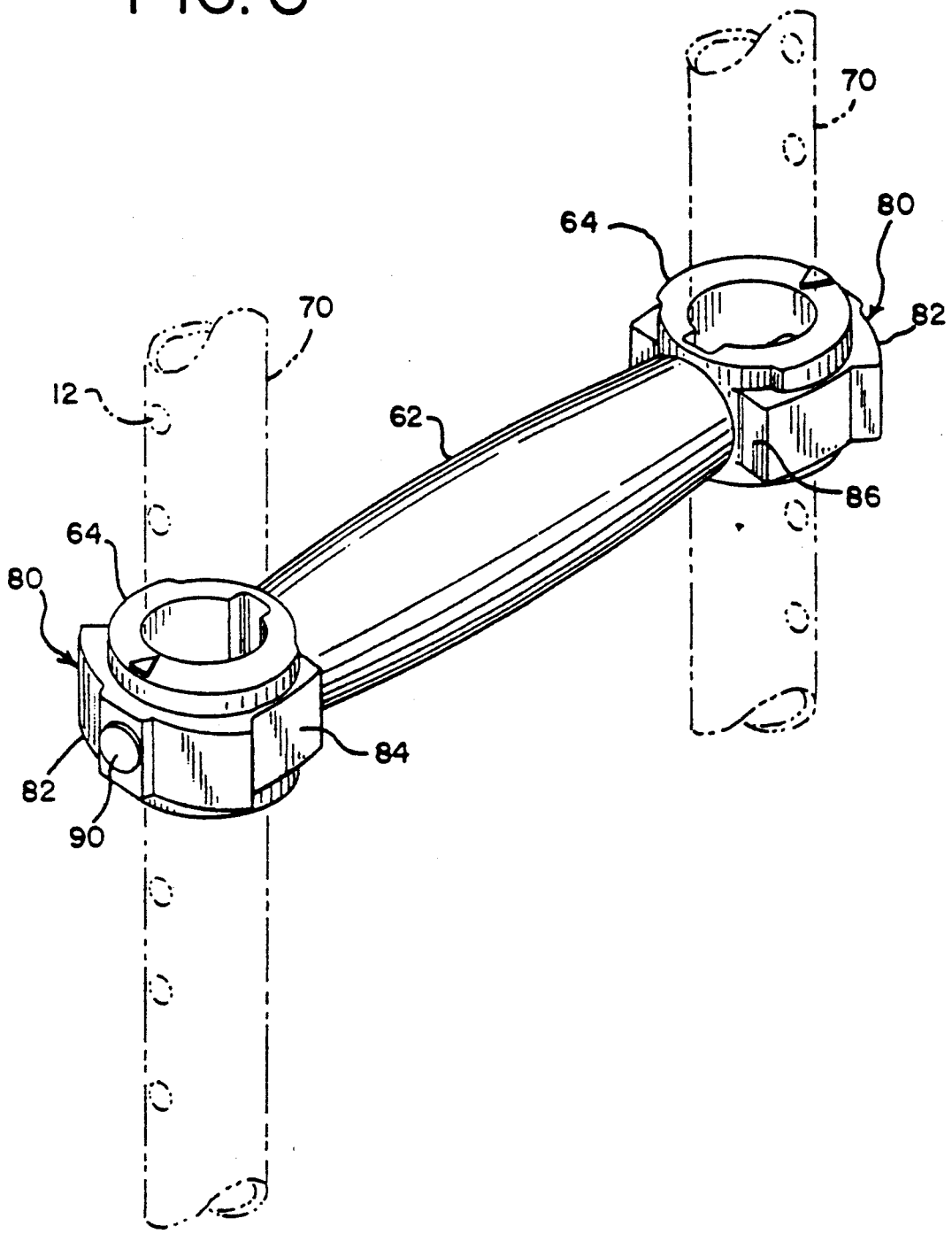
FIG. 6 is a partial perspective view showing the orthopedic crutch with an alternative hand grip embodiment with the hand grip locked in the engaged position.
Figure 7:
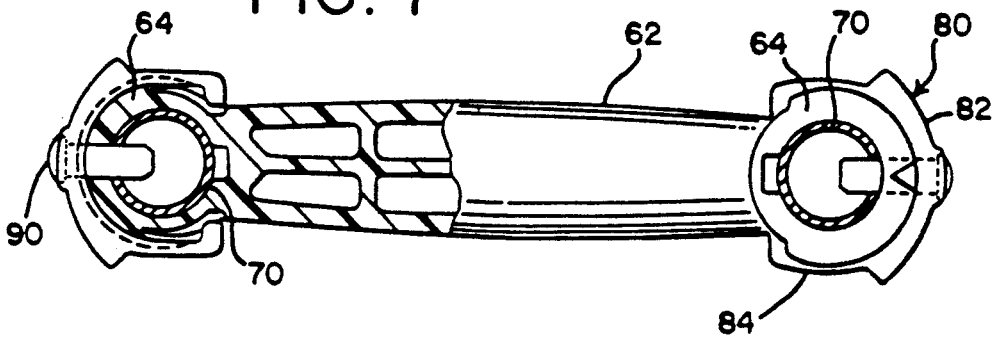
FIG. 7 is a top view with a partial cut-away in cross section showing the locking member of FIG. 6 engaged.
Figure 8:
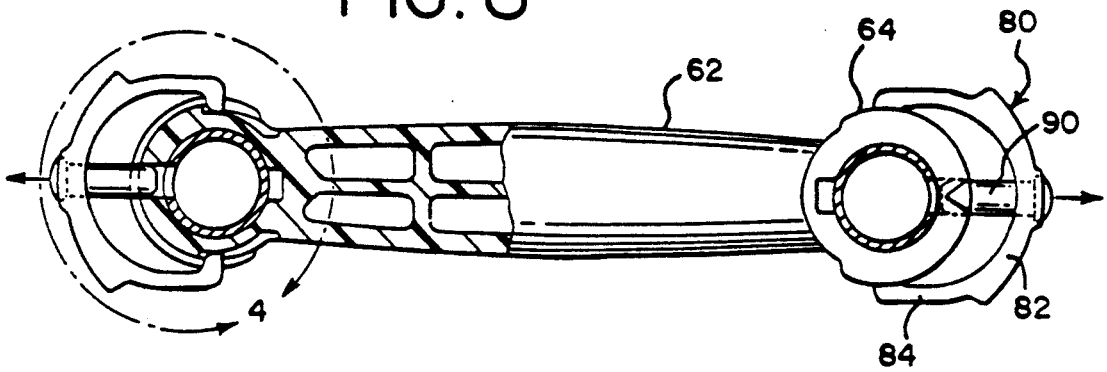
FIG. 8 is a top view similar to FIG. 7 showing the locking member in the disengaged position.
Figure 9:
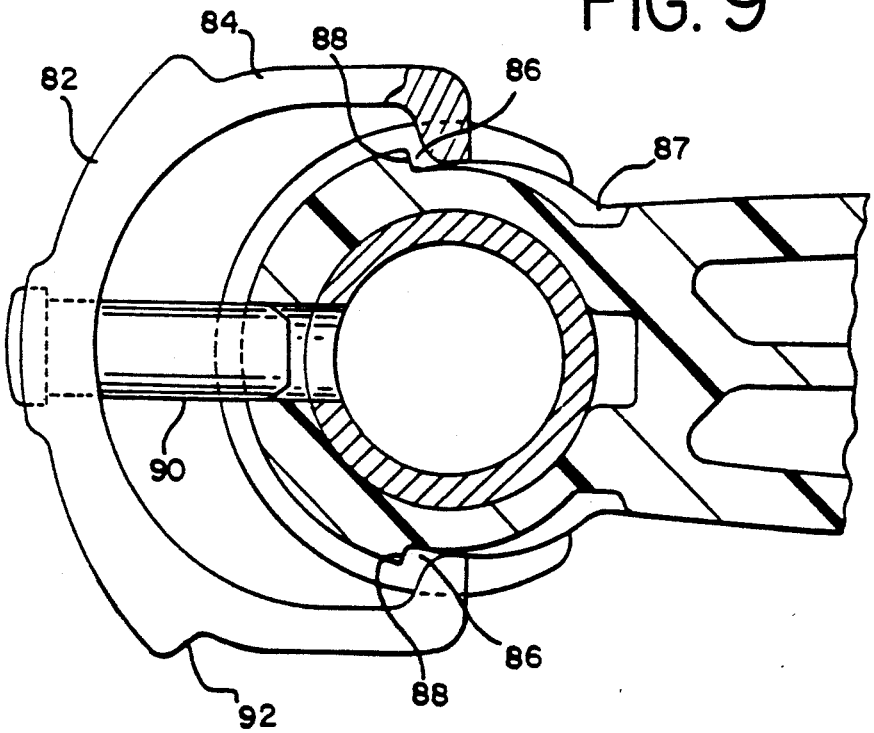
FIG. 9 is an exploded view showing, in detail, the locking member in FIG. 8 disengaged.

An alternative, and presently preferred embodiment of the hand grip is shown in FIGS. 6–9, wherein like numerals also refer to like parts. In FIG. 6 and FIG. 7 the hand grip locking member is shown in the engaged or locked position. In FIGS. 8 and 9 the locking member is shown disengaged.

The hand grip 60 in this embodiment comprises a bracket 62 rigidly connecting sleeves 64 which are slidable longitudinally on vertical tubular supports, which are similar to the vertical supports 10 shown in FIG. 1. The locking member 80 in this embodiment comprises a generally U-shaped clamp 82 having legs 84 which surround at least a portion of sleeve 64 and a pin 90 fixed to clamp 82. The U-shaped clamp 82 is sized to snugly embrace sleeve 64 but is advantageously provided with projections 86 at the end of the legs 84, best seen in FIG. 9, which make firm contact with the external surface of sleeve 64. The projections 86 are biased into contact with the sleeve 64 by, for example, being slightly undersized with respect to the outside diameter of the sleeve. A slight depression 87 may be formed at the external surface of the sleeve or junction of the sleeve and bracket to receive the projection 86 when the clamp is in the engaged position, as shown in FIG. 7, with the locking pin 90 inserted through aligned apertures in sleeves 64 and vertical supports 70. When the locking device is in this position, the hand grip 60 is firmly supported between vertical supports 70 and can sustain the weight of the user of the crutch.

To adjust the vertical elevation of the hand grip with respect to the arm rest, to accommodate the user, the locking member may be disengaged from the vertical supports by applying pressure with fingers to finger rests 92 to pull or push the clamp 82 outwardly, or to projections 86, so that the locking pin is moved out of the vertical supports 70 into the position shown in FIG. 8, thereby permitting the hand grip to slide longitudinally on the vertical supports 70. With the clamp is disengaged from the locking position, projections 86 will come to rest against stop means 88 provided on the external surface of the sleeve to limit outward movement of the clamp when it is moved from the engaged to the disengaged position. When the hand grip is in a suitable position for the user, the pin may be moved to the locking position by moving the clamps toward the vertical supports as shown in FIG. 7 so that the pin 90 is moved through the closest aligned apertures in the sleeve 64 and into vertical tubular support 70.

Advantageously, as described in connection with the first embodiment, the sleeve and bracket may comprise a unitary molded plastic member of suitably rigid plastic material such as polypropylene. The pin 90 is preferably metallic since it engages the vertical supports which are also generally, and preferably, of metallic material. The apertures in the vertical supports may be either drilled or punched into a longitudinal surface thereof. As indicated previously, the pin 90 is fixed to the clamp 82 such as by being fixed in situ during the molding of the plastic clamp, or the pin can be threaded to the clamp or retained by a nut or lock washer.

It is apparent from the foregoing that various changes and modifications may be made to the orthopedic crutch with a quick adjustment hand grip according to the present invention without departing from the scope thereof.

Accordingly, the scope of the invention should be limited only by the appended claims wherein what is claimed is:

1. An orthopedic crutch comprising:

a pair of spaced apart, generally parallel vertical supports rigidly attached to one another, an arm support attached to the upper ends of said vertical supports and a vertically adjustable hand grip fixable to said vertical supports;

each of said vertical supports having a plurality of spaced apart detents along a longitudinal surface;

said hand grip comprising an annular sleeve surrounding each vertical support and a bracket extending between said vertical supports rigidly connecting said sleeves, said hand grip being adapted to engage and be supported by said vertical supports;

each of said sleeves having an aperture generally tangential to the vertical supports;

a rotatable locking member with a detent engaging surface to firmly engage a detent in said vertical supports and another surface which does not engage said detents disposed in said aperture and fixed to said sleeve;

means to rotate the locking member so that said hand grip may be vertically adjusted by rotatably disengaging and engaging said detents in said vertical supports to place said hand grip at an adjustable distance from said arm support.

2. An orthopedic crutch comprising:

a pair of generally parallel, vertical tubular supports rigidly attached to one another, each of said tubular supports having a plurality of spaced apart detents along one longitudinal surface;

an arm support attached to the upper ends of said vertical supports;

a hand grip comprising a tubular sleeve surrounding each vertical support and slidable thereover and a bracket extending between the vertical supports rigidly connecting said sleeves, each sleeve having an aperture therethrough adjacent and generally tangential to a vertical support;

a rotatable locking member disposed in said aperture, said locking member having a detent engaging surface extendible into said detents to firmly engage said vertical support and another surface not extendible within said detents, said locking member firmly fixing said hand grip to said vertical supports when said detent engaging surface is extended within the detent;

means to rotate said locking member to disengage and engage said detents to enable said hand grip to be placed and fixed at an adjustable distance from said arm support.

3. An orthopedic crutch according to claim 2 wherein said sleeves and bracket of said hand grip comprise a unitary molded plastic structure.

4. An orthopedic crutch according to claim 2 wherein said locking member comprises a cylindrical element with a "D"-shaped notch intermediate the ends thereof of semi-circular cross section, the semi-circular section being engageable with the vertical support in a detent therein.

5. An orthopedic crutch according to claim 4 wherein said means to rotate said locking member is fixed to the locking member.

6. An orthopedic crutch according to claim 5 wherein said locking member comprises a metallic or rigid plastic material.

* * * * *